US007618114B2

(12) United States Patent
Endo

(10) Patent No.: US 7,618,114 B2
(45) Date of Patent: Nov. 17, 2009

(54) LIQUID EJECTION METHOD AND LIQUID EJECTING APPARATUS

(75) Inventor: Hironori Endo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 571 days.

(21) Appl. No.: 11/475,073

(22) Filed: Jun. 27, 2006

(65) Prior Publication Data

US 2006/0256150 A1 Nov. 16, 2006

Related U.S. Application Data

(63) Continuation of application No. 10/656,813, filed on Sep. 8, 2003, now Pat. No. 7,093,916.

(30) Foreign Application Priority Data

Sep. 9, 2002 (JP) ..... 2002-262975

(51) Int. Cl.
*B41J 29/393* (2006.01)

(52) U.S. Cl. ..... 347/19; 347/105

(58) Field of Classification Search ..... 347/12, 347/15, 19, 14, 101, 104, 105
See application file for complete search history.

(56) References Cited

U.S. PATENT DOCUMENTS 5,041,850 A * 8/1991 Kahoyashi et al. ..... 347/157
5,466,079 A 11/1995 Quintana
5,997,129 A 12/1999 Matsuhashi
6,447,089 B1 9/2002 Arquilevich et al.

FOREIGN PATENT DOCUMENTS

| | | |
|---|---|---|
| JP | 02-255360 | 10/1990 |
| JP | 04-021482 | 1/1992 |
| JP | 08-169155 A | 7/1996 |
| JP | 2001096874 A | 4/2001 |
| JP | 2002-103721 | 4/2002 |
| JP | 2002-240253 | 8/2002 |
| JP | 2003-237063 | 8/2003 |
| JP | 2004-082631 | 3/2004 |
| JP | 2004-098445 | 4/2004 |

* cited by examiner

*Primary Examiner*—Lamson D Nguyen
(74) *Attorney, Agent, or Firm*—Sughrue Mion, PLLC

(57) ABSTRACT

A liquid ejection method of ejecting liquid from a movable ejection head onto a medium comprises the steps of: detecting a position of an end of the medium; and changing, according to a feed amount of the medium fed after the position of the end of the medium has been detected, at least either a starting position or a terminating position for ejecting the liquid from the ejection head being moved.

10 Claims, 11 Drawing Sheets

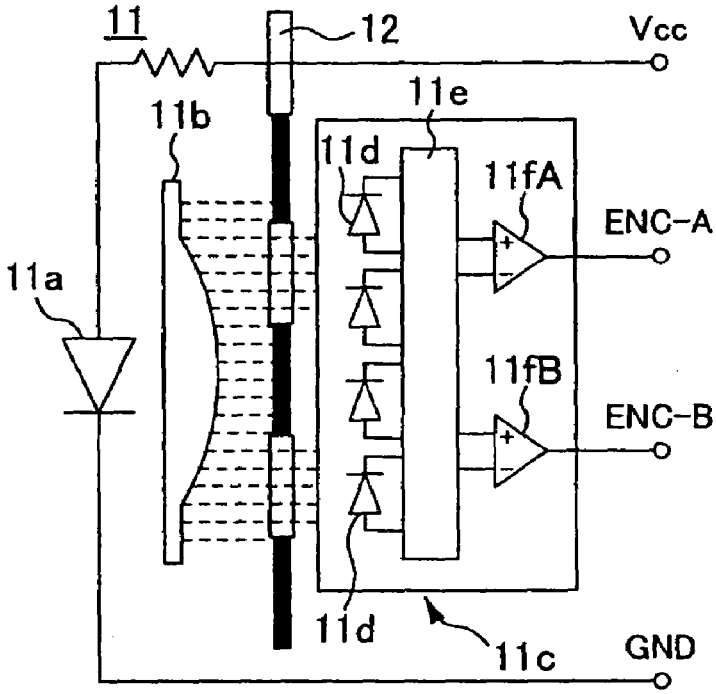
FIG. 5
FIG. 6A
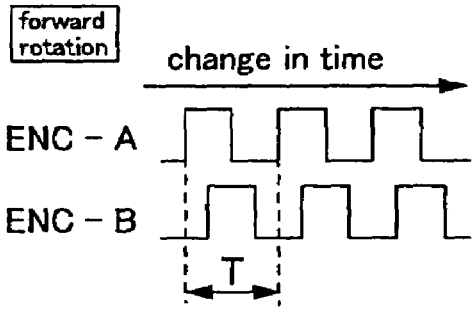
FIG. 6B
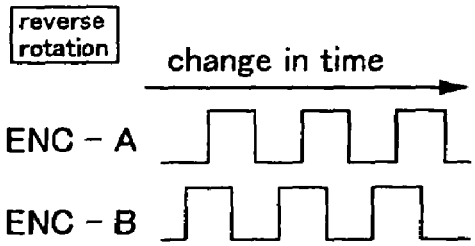

LIQUID EJECTION METHOD AND LIQUID EJECTING APPARATUS

CROSS-REFERENCE TO RELATED APPLICATIONS

This is a continuation of Application No. 10/656,813 filed Sep. 8, 2003 now U.S. Pat. No. 7,093,916. The entire disclosure of the prior application, Application No. 10/656,813 is hereby incorporated by reference.

The present application claims priority upon Japanese Patent Application No. 2002-262975 filed Sep. 9, 2002, which is herein incorporated by reference.

BACKGROUND OF THE INVENTION

1. Field of the Invention

The present invention relates to a liquid ejection method and a liquid ejecting apparatus.

2. Description of the Related Art

Color inkjet printers are already well known as representative liquid ejection apparatuses. These color inkjet printers are provided with a print head, which is an example of an inkjet-type ejection head, for ejecting ink, which is an example of a liquid, from nozzles, and are configured so as to record images and characters, for example, by ejecting ink onto print paper, which is an example of a medium.

The print head is supported on a carriage in a state with the nozzle face in which the nozzles are formed in opposition to the print paper, and is moved (in a main scan) in the width direction of the print paper along a guide member, ejecting ink in synchronization with this main scan.

Moreover, color inkjet printers that allow so-called borderless printing, in which the entire surface of the print paper is targeted for printing, have become popular in recent years because, among other things, they allow an output result of an image that is comparable to a photograph to be obtained. Borderless printing for example allows printing to be carried out by ejecting ink without leaving borders at the four edges of the print paper.

In case of performing borderless printing, since printing is carried out with respect to the entire surface of the print paper, it is important that no borders are created on the end sections of the print paper being printed. In order to do so, it is advantageous to prepare print data that is somewhat larger than the print paper, i.e., that has somewhat of a margin compared to the size of the print paper, and to print on the print paper using such print data, giving consideration to situations in which the print paper is supplied in a slanted (skewed) manner.

Further, in order to alleviate the problem caused when adopting the above-mentioned method, that is, the problem that ink is wasted because printing is performed in regions outside the print paper, it is also advantageous to detect the position of the end of the print paper using a detector such as a sensor, and change the starting position and/or the terminating position for ejecting ink in accordance with the detected end position.

However, in adopting the above-mentioned measure, ink will be wasted if the starting position and/or the terminating position for ejecting ink from the print head is determined without giving any consideration to the feed amount by which the print paper is fed using a paper feed motor after the position of the end of the print paper has been detected.

More specifically, the appropriate starting position or the terminating position for ejecting ink when giving consideration to such aspects as not to create any unnecessary borders in the print paper while causing no waste of ink will change according to the magnitude of the feed amount by which the print paper is fed by the paper feed motor after the position of the end of the print paper has been detected. Despite such a fact, if the starting position or the terminating position for ejecting ink is determined irrelevant to the feed amount, the timing at which ink ejection is started will be excessively advanced and the timing at which the ink ejection is terminated will be excessively delayed as a result of placing too much importance on trying to keep unnecessary borders from being created on the print paper without taking the magnitude of the feed amount into consideration. This gives rise to the problem that ink is wasted.

SUMMARY OF THE INVENTION

The present invention has been made in view of the circumstances mentioned above, and an object thereof is to provide a liquid ejection method and a liquid ejecting apparatus capable of reducing the amount of liquid consumed.

An aspect of the present invention is a liquid ejection method of ejecting liquid from a movable ejection head onto a medium, the method comprising the steps of: detecting a position of an end of the medium; and changing, according to a feed amount of the medium fed after the position of the end of the medium has been detected, at least either a starting position or a terminating position for ejecting the liquid from the ejection head being moved.

Features and objects of the present invention other than the above will become clear by reading the description of the present specification with reference to the accompanying drawings.

BRIEF DESCRIPTION OF THE DRAWINGS

In order to facilitate further understanding of the present invention and the advantages thereof, reference is now made to the following description taken in conjunction with the accompanying drawings wherein:

FIG. 5 is an explanatory diagram that schematically shows a configuration of a linear encoder 11 attached to the carriage 28 according to an embodiment of the present invention;

FIG. 6A is a timing chart showing the waveforms of the two output signals of the linear encoder 1 when a CR motor is rotating forward, and FIG. 6B is a timing chart showing the waveforms of the two output signals of the linear encoder 11 when the CR motor is rotating in reverse, according to an embodiment of the present invention;

DETAILED DESCRIPTION OF THE INVENTION

Figure 1:
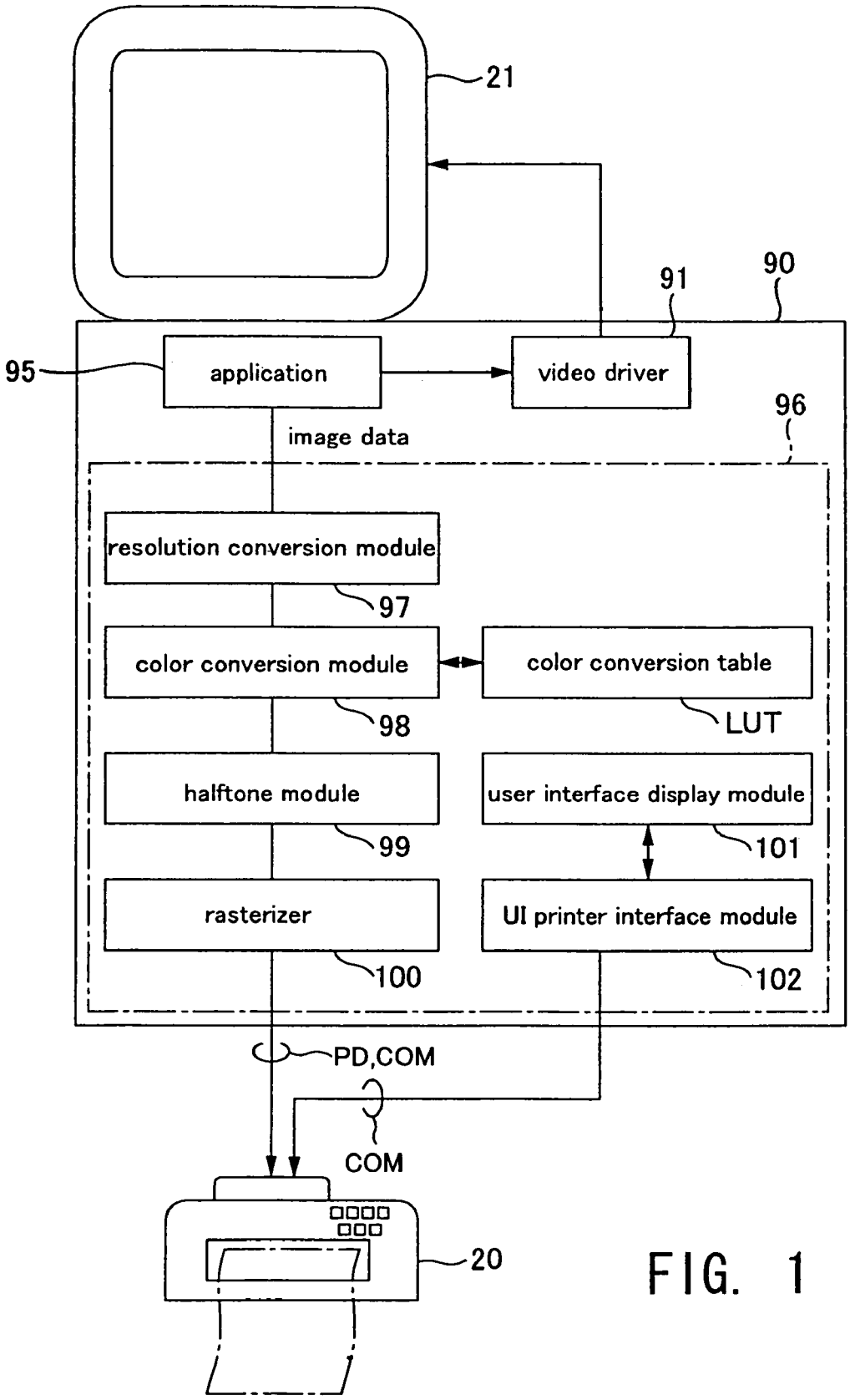
FIG. 1 is a block diagram showing a configuration of a printing system serving as an example of the present invention.

At least the following matters will be made clear by the explanation in the present specification and the description of the accompanying drawings.

An aspect of the present invention is a liquid ejection method of ejecting liquid from a movable ejection head onto a medium, the method comprising the steps of: detecting a position of an end of the medium; and changing, according to a feed amount of the medium fed after the position of the end of the medium has been detected, at least either a starting position or a terminating position for ejecting the liquid from the ejection head being moved.

By changing at least either a starting position or a terminating position for ejecting the liquid from the ejection head being moved according to a feed amount of the medium fed after the position of the end of the medium has been detected, it becomes possible to reduce the amount of liquid consumed.

Further, it is preferable that the ejection head starts liquid ejection at the starting position and terminates liquid ejection at the terminating position; and the greater the feed amount is, the further the start of liquid ejection is advanced or the further the termination of liquid ejection is delayed.

In this way, it becomes possible to reduce the amount of liquid consumed more effectively.

Further, it is preferable that the start of liquid ejection is advanced or the termination of liquid ejection is delayed in proportion to a magnitude of the feed amount.

In this way, it becomes possible to determine the appropriate liquid ejection starting position or liquid ejection terminating position, giving consideration to such aspects such as not to create any unnecessary margins (borders) in the medium while causing no waste of liquid.

Further, it is preferable that at least either the starting position or the terminating position for ejecting the liquid from the ejection head being moved is changed according to the feed amount of the medium fed after the position of the end of the medium has been detected, and a predicted maximum skew angle of the medium.

In this way, it becomes possible to easily achieve the above-mentioned effect, that is, the effect of being able to reduce the amount of liquid used.

Further, it is preferable that the liquid is ejected targeting on an entire surface of the medium.

The advantages obtained by the above-mentioned measures become more significant when liquid is ejected targeting on the entire surface of the medium, because liquid will be ejected also onto the end sections of the medium.

Further, it is preferable that the position of the end of the medium is detected by a sensor; the sensor includes a light emitting section for emitting light, and a light receiving sensor for receiving the light that moves in a main-scanning direction in accordance with a movement of the sensor in the main-scanning direction; and the position of the end of the medium is detected according to a change in an output value of the light receiving sensor that is caused by passing of the light, which has been emitted from the light emitting section moving in the main-scanning direction, across the end of the medium.

In this way, it becomes possible to detect the end position more easily.

Further, it is preferable that each position of two ends of the medium that differ in position in the main-scanning direction is detected according to a change in output values of the light receiving sensor that is caused by passing of the light, which has been emitted from the light emitting section moving in the main-scanning direction, across each of the two ends of the medium; the starting position is changed in accordance with the position of one of the two ends having been detected; and the terminating position is changed in accordance with the position of the other one of the two ends having been detected.

In this way, the above-mentioned effect, that is, the effect of being able to reduce the amount of liquid consumed will be brought about more significantly.

Further, it is preferable that the position of the end of the medium is detected by a sensor; the sensor is provided in/on a movable moving member that comprises the ejection head; and the sensor includes a light emitting section for emitting light, and a light receiving sensor for receiving the light that moves in a main-scanning direction in accordance with a movement of the sensor in the main-scanning direction.

In this way, the moving member and the mechanism for moving the sensor can be used in common.

Further, it is preferable that, while making the moving member move in a main-scanning direction, the position of the end of the medium is detected according to a change in an output value of the light receiving sensor that is caused by passing of the light, which has been emitted from the light emitting section moving in the main-scanning direction, across the end of the medium, and the liquid is ejected from the ejection head onto the medium.

In this way, it becomes possible to realize efficient operation of a liquid ejecting apparatus.

Further, it is preferable that the liquid is ink; and printing is carried out on a print medium, which is the medium, by ejecting the ink from the ejection head.

In this way, it becomes possible to realize a printing method that achieves the effects mentioned above.

Another aspect of the present invention is a liquid ejecting apparatus comprising: a movable ejection head for ejecting liquid; a feed mechanism for feeding a medium; and a sensor for detecting a position of an end of the medium, wherein at least either a starting position or a terminating position for ejecting the liquid from the ejection head being moved is changed according to a feed amount of the medium fed by the feed mechanism after the position of the end of the medium has been detected by the sensor.

According to such a liquid ejecting apparatus, by changing at least either a starting position or a terminating position for ejecting the liquid from the ejection head being moved according to a feed amount of the medium fed by the feed mechanism after the position of the end of the medium has been detected by the sensor, it becomes possible reduce the amount of liquid consumed.

Example of the Overall Configuration of the Apparatus

FIG. 1 is a block diagram showing the configuration of a printing system serving as an example of the present invention. The printing system is provided with a computer 90 and a color inkjet printer 20, which is an example of a liquid ejection apparatus. It should be noted that the printing system including the color inkjet printer 20 and the computer 90 can also be broadly referred to as a "liquid ejection apparatus." Although not shown in the diagram, a computer system is made of the computer 90, the color inkjet printer 20, a display device such as a CRT 21 or a liquid crystal display device, input devices such as a keyboard and a mouse, and a drive device such as a flexible drive device or a CD-ROM drive device.

In the computer 90, an application program 95 is executed under a predetermined operating system. The operating system includes a video driver 91 and a printer driver 96, and the application program 95 outputs print data PD for transfer to the color inkjet printer 20 through these drivers. The application program 95, which carries out retouching of images, for example, carries out a desired process with respect to an image to be processed, and also displays the image on the CRT 21 via the video driver 91.

When the application program 95 issues a print command, the printer driver 96 of the computer 90 receives image data from the application program 95 and converts these into print data PD to be supplied to the color inkjet printer 20. The printer driver 96 is internally provided with a resolution conversion module 97, a color conversion module 98, a halftone module 99, a rasterizer 100, a user interface display module 101, a UI printer interface module 102, and a color conversion look-up table LUT.

The resolution conversion module 97 performs the function of converting the resolution of the color image data formed by the application program 95 to a print resolution. The image data whose resolution is thus converted is image information still made of the three color components RGB. The color conversion module 98 refers to the color conversion look-up table LUT and, for each pixel, converts the RGB image data into multi-gradation data of a plurality of ink colors that can be used by the color inkjet printer 20.

The multi-gradation data that have been color converted have a gradation value of 256 grades, for example. The halftone module 99 executes so-called halftone processing to create halftone image data. The halftone image data are arranged by the rasterizer 100 into the order in which they are to be transferred to the color inkjet printer 20, and are output as the final print data PD. The print data PD include raster data indicating the state in which dots are formed during main scanning, and data indicating the sub-scanning feed amount.

The user interface display module 101 has a function for displaying various types of user interface windows related to printing and a function for receiving input from the user in these windows.

The UI printer interface module 102 functions as an interface between the user interface (UI) and the color inkjet printer. It interprets instructions given by users through the user interface and sends various commands COM to the color inkjet printer. Conversely, it also interprets commands COM received from the color inkjet printer and executes various displays with respect to the user interface.

It should be noted that the printer driver 96 realizes, for example, a function for sending and receiving various types of commands COM and a function for supplying print data PD to the color inkjet printer 20. A program for realizing the functions of the printer driver 96 is supplied in a format in which it is stored on a computer-readable storage medium. Examples of this storage medium include various types of computer-readable media, such as flexible disks, CD-ROMs, magneto optical disks, IC cards, ROM cartridges, punch cards, printed materials on which a code is printed such as a bar code, internal storage devices (memory such as a RAM or a ROM) and external storage devices of the computer. The computer program can also be downloaded onto the computer 90 via the Internet.

Figure 2:
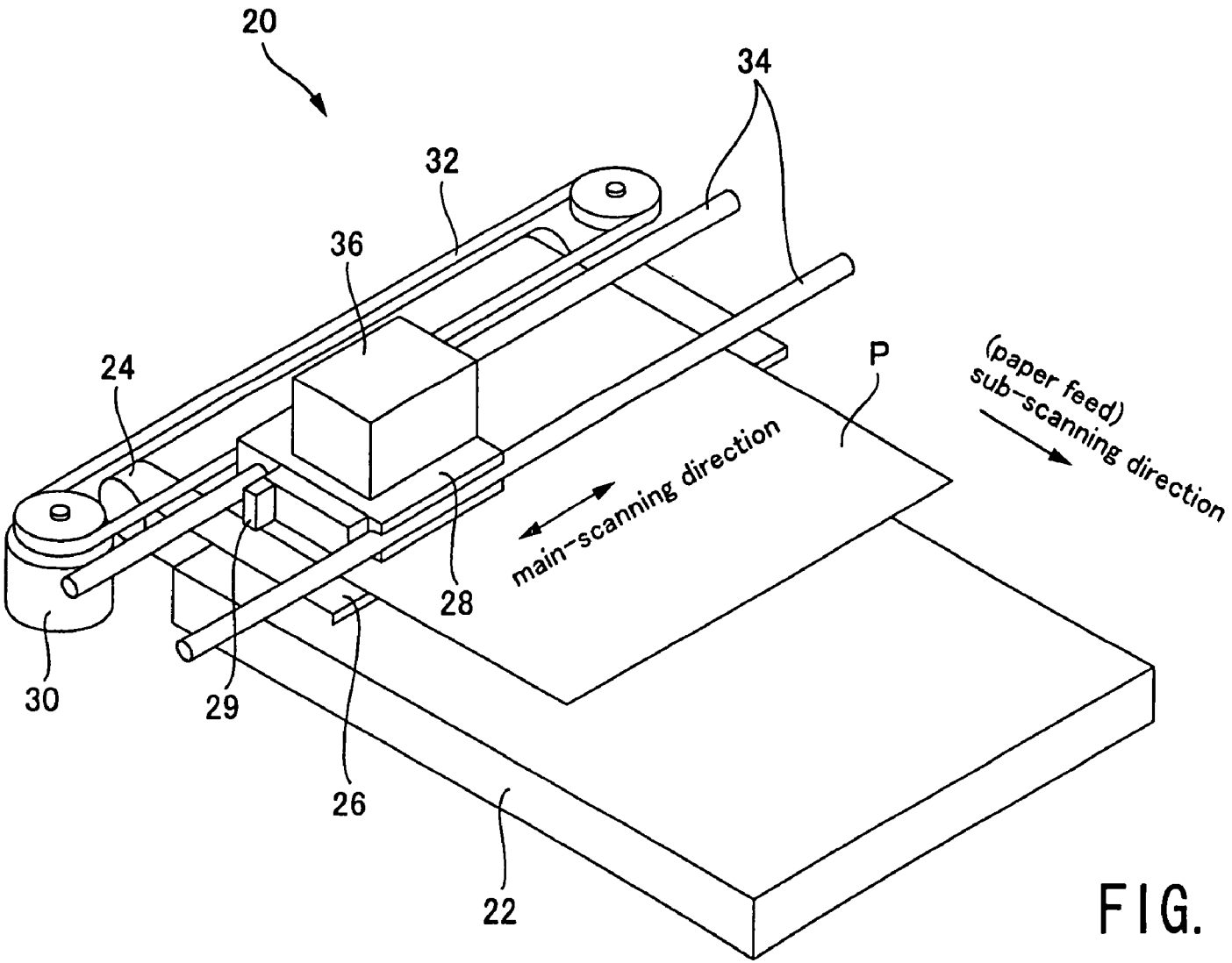
FIG. 2 is a schematic perspective view showing an example of some primary structures of a color inkjet printer 20 according to an embodiment of the present invention.

FIG. 2 is a schematic perspective view showing an example of the primary structures of the color inkjet printer 20. The color inkjet printer 20 is provided with a paper stacker 22, a paper feed roller 24 driven by a step motor that is not shown, a platen 26, a carriage 28, which comprises a print head for creating dots and which serves as an example of a movable moving member, a carriage motor 30, a pull belt 32 that is driven by the carriage motor 30, and guide rails 34 for the carriage 28. A print head 36, which is an example of an ejection head provided with numerous nozzles, and a reflective optical sensor 29, which is an example of a sensor or detector, that will be described in detail later are mounted onto the carriage 28.

The print paper P is rolled from the paper stacker 22 by the paper feed roller 24 and fed in a paper feed direction (hereinafter also referred to as the sub-scanning direction), which is an example of the predetermined feed direction, over the surface of the platen 26. The carriage 28 is pulled by the pull belt 32, which is driven by the carriage motor 30, and moves in the main-scanning direction along the guide rails 34. It should be noted that as shown in the diagram, the main scanning direction refers to the two directions perpendicular to the sub-scanning direction. The paper feed roller 24 is also used to carry out the paper-feed operation for supplying the print paper P to the color inkjet printer 20 and the paper discharge operation for discharging the print paper P from the color inkjet printer 20.

Example of Configuration of the Reflective Optical Sensor

Figure 3:
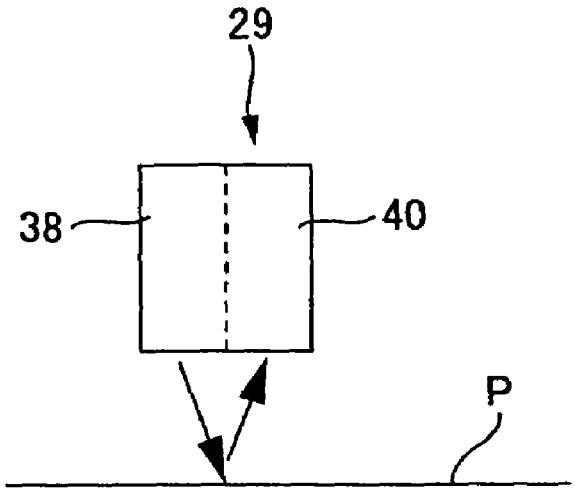
FIG. 3 is a schematic diagram for describing an example of a reflective optical sensor 29.

FIG. 3 is a schematic diagram for describing an example of the reflective optical sensor 29. The reflective optical sensor 29 is attached to the carriage 28, and has a light emitting section 38, which is for example made of a light emitting diode and is an example of a light-emitting member, and a light-receiving section 40, which is for example made of a phototransistor and is an example of a light-receiving sensor. The light that is emitted from the light emitting section 38, that is, the incident light, is reflected by print paper P or by the platen 26 if there is no print paper P in the direction of the emitted light. The light that is reflected is received by the light-receiving section 40 and is converted into an electrical signal. Then, the magnitude of the electrical signal is measured as the output value of the light-receiving sensor corresponding to the intensity of the reflected light that is received.

It should be noted that in the above description, as shown in the figure, the light emitting section 38 and the light-receiving section 40 are provided as a single unit and together constitute the reflective optical sensor 29. However, they may also constitute separate devices, such as a light emitting device and a light-receiving device.

Also, in the above description, the reflected light was converted into an electrical signal and then the magnitude of that electrical signal was measured in order to obtain the intensity of the reflected light that is received. However, this is not a limitation, and it is only necessary that the output value of the light-receiving sensor corresponding to the intensity of the reflected light that is received can be measured.

Example of Configuration of the Carriage Area

Figure 4:
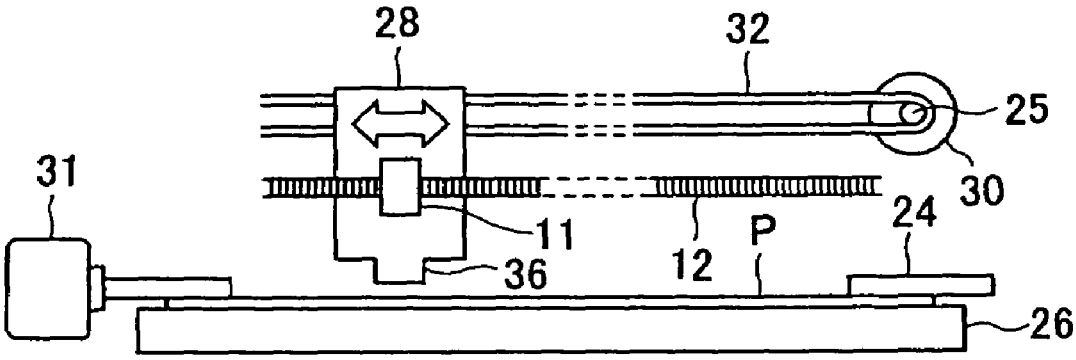
FIG. 4 is a diagram showing a configuration of a carriage 28 area of the inkjet printer according to an embodiment of the present invention.

The configuration of the carriage area is described next. FIG. 4 is a diagram showing the configuration of the carriage 28 area of the inkjet printer.

The inkjet printer shown in FIG. 4 is provided with a paper feed motor (hereinafter referred to as "PF motor") 31, which is as an example of the feed mechanism for feeding paper, the carriage 28 to which the print head 36 for ejecting ink, which is an example of a liquid, onto the print paper P is fastened and which is driven in the main-scanning direction, the carriage motor (hereinafter referred to as "CR motor") 30 for driving the carriage 28, a linear encoder 11 that is fastened to the carriage 28, a code plate 12 for the linear encoder in which slits are formed at a predetermined spacing, a rotary encoder 13, which is not shown, for the PF motor 31, the platen 26 for supporting the print paper P, the paper feed roller 24 driven by the PF motor 31 for carrying the print paper P, a pulley 25 attached to the rotational shaft of the CR motor 30, and the pull belt 32 driven by the pulley 25.

Next, the above-described linear encoder 11 and the rotary encoder 13 are described. FIG. 5 is an explanatory diagram that schematically shows the configuration of the linear encoder 11 attached to the carriage 28.

The linear encoder 11 shown in FIG. 5 is provided with a light emitting diode 11*a*, a collimating lens 11*b*, and a detection processing section 11*c*. The detection processing section 11*c* has a plurality of (for example, four) photodiodes 11*d*, a signal processing circuit 11*e*, and for example two comparators 11*f*A and 11*f*B.

The light-emitting diode 11*a* emits light when a voltage Vcc is applied to it via resistors on both sides. This light is condensed into parallel light by the collimating lens 11*b* and passes through the code plate 12 of the linear encoder. The code plate 12 of the linear encoder is provided with slits at a predetermined spacing (for example, 1/180 inch (one inch=2.54 cm)).

The parallel light that passes through the code plate 12 of the linear encoder then passes through stationary slits (not shown) and is incident on the photodiodes 11*d*, where it is converted into electrical signals. The electrical signals that are output from the four photodiodes 11*d* are subjected to signal processing by the signal processing circuit 11*e*, the signals that are output from the signal processing circuit 11*e* are compared in the comparators 11*f*A and 11*f*B, and the results of these comparisons are output as pulses. Then, the pulse ENC-A and the pulse ENC-B that are output from the comparators 11*f*A and 11*f*B become the output of the linear encoder 11.

FIG. 6A is a timing chart showing the waveforms of the two output signals of the linear encoder 11 when the CR motor is rotating forward. FIG. 6B is a timing chart showing the waveforms of the two output signals of the linear encoder 11 when the CR motor is rotating in reverse.

As shown in FIG. 6A and FIG. 6B, the phases of the pulse ENC-A and the pulse ENC-B are misaligned by 90 degrees both when the CR motor is rotating forward and when it is rotating in reverse. When the CR motor 30 is rotating forward, that is, when the carriage 28 is moving in the main-scanning direction, then, as shown in FIG. 6A, the phase of the pulse ENC-A leads the phase of the pulse ENC-B by 90 degrees. On the other hand, when the CR motor 30 is rotating in reverse, then, as shown in FIG. 6B, the phase of the pulse ENC-A is delayed by 90 degrees with respect to the phase of the pulse ENC-B. A single period T of the pulse ENC-A and the pulse ENC-B is equivalent to the time during which the carriage 28 is moved by the slit spacing of the code plate 12 of the linear encoder.

Then, the rising edge and the rising edge of the output pulses ENC-A and ENC-B of the linear encoder 11 are detected, and the number of detected edges is counted. The rotational position of the CR motor 30 is detected based on the number that is calculated. With respect to the calculation, when the CR motor 30 is rotating forward a "+1" is added for each detected edge, and when the CR motor 30 is rotating in reverse a "−1" is added for each detected edge. The period of the pulses ENC-A and ENC-B is equal to the time from when one slit of the code plate 12 of the linear encoder passes through the linear encoder 11 to when the next slit passes through the linear encoder 11, and the phases of the pulse ENC-A and the pulse ENC-B are misaligned by 90 degrees. Accordingly, a count number of "1" of the calculation corresponds to ¼ of the slit spacing of the code plate 12 of the linear encoder. Therefore, if the counted number is multiplied by ¼ of the slit spacing, then the amount that the CR motor 30 has moved from the rotational position corresponding to the count number "0" can be obtained based on this product. The resolution of the linear encoder 11 at this time is ¼ the slit spacing of the code plate 12 of the linear encoder.

On the other hand, the rotary encoder 13 for the PF motor 31 has the same configuration as the linear encoder 11, except that the rotary encoder code plate 14 is a rotation disk that rotates in conjunction with rotation of the PF motor 31. The rotary encoder 13 outputs two output pulses ENC-A and ENC-B, and based on this output the amount of movement of the PF motor 31 can be obtained.

Example of the Electrical Configuration of the Color Inkjet Printer

Figure 7:
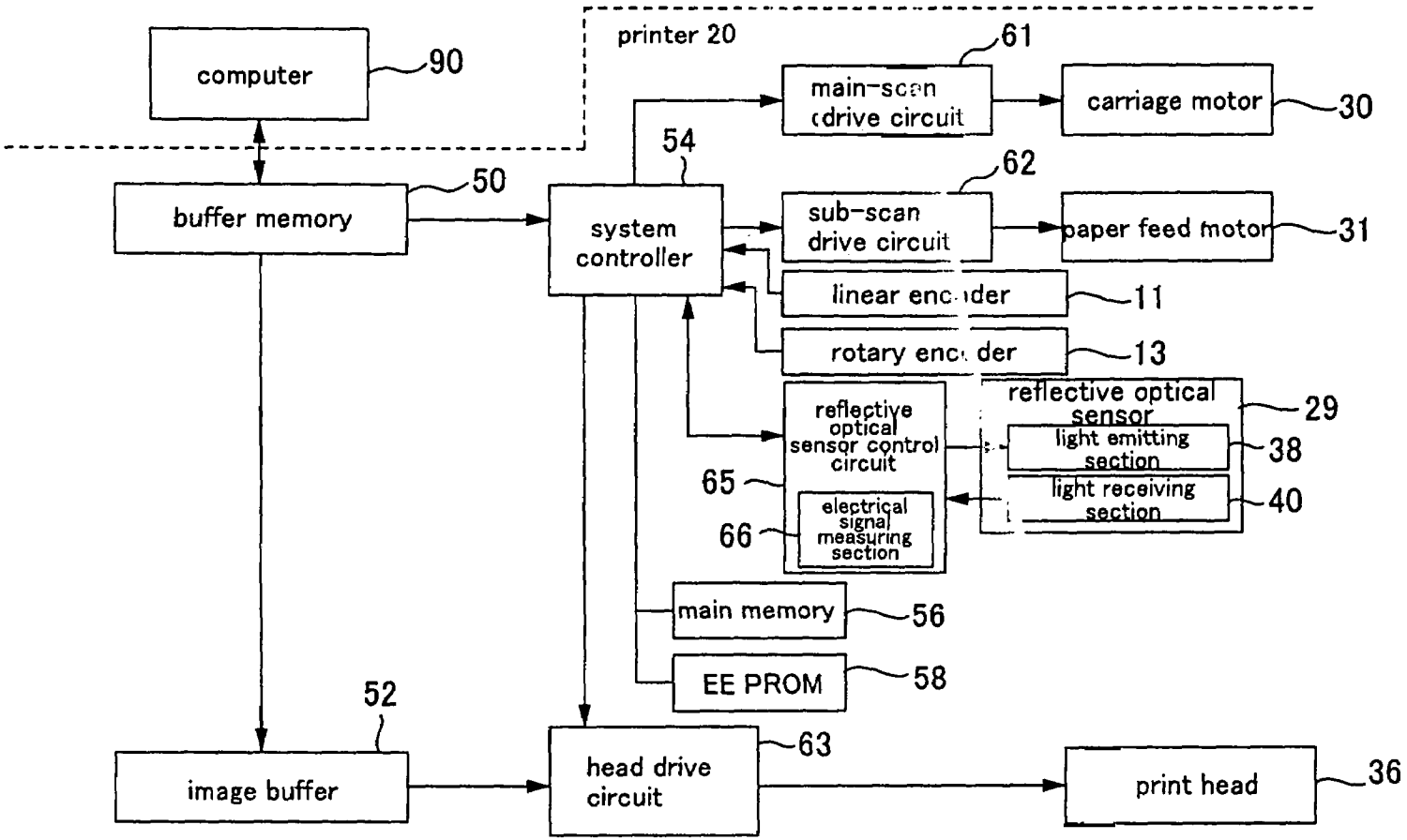
FIG. 7 is a block diagram showing an example of the electrical configuration of the color inkjet printer 20 according to an embodiment of the present invention.

FIG. 7 is a block diagram showing an example of the electrical configuration of the color inkjet printer 20. The color inkjet printer 20 is provided with a buffer memory 50 for receiving signals supplied from the computer 90, an image buffer 52 for storing print data, a system controller 54 for controlling the overall operation of the color inkjet printer 20, a main memory 56, and an EEPROM 58. The system controller 54 is connected to a main-scan drive circuit 61 for driving the carriage motor 30, a sub-scan drive circuit 62 for driving the paper feed motor 31, a head drive circuit 63 for driving the print head 36, a reflective optical sensor control circuit 65 for controlling the light emitting section 38 and the light-receiving section 40 of the reflective optical sensor 29, the above-described linear encoder 11, and the above-described rotary encoder 13. Also, the reflective optical sensor control circuit 65 is provided with an electrical signal measuring section 66 for measuring the electrical signals that are converted from the reflected light received by the light-receiving section 40.

The print data that are transferred from the computer 90 are held temporarily in the buffer memory 50. Within the color inkjet printer 20, the system controller 54 reads necessary information from the print data in the buffer memory 50, and based on this information, sends control signals to the main-scan drive circuit 61, the sub-scan drive circuit 62, and the head drive circuit 63, for example.

The image buffer 52 stores print data for a plurality of color components that are received by the buffer memory 50. The head drive circuit 63 reads the print data of the various color components from the image buffer 52 in accordance with the control signals from the system controller 54, and drives the various color nozzle arrays provided in the print head 36 in correspondence with the print data.

Example of Nozzle Arrangement of Print Head, etc.

Figure 8:
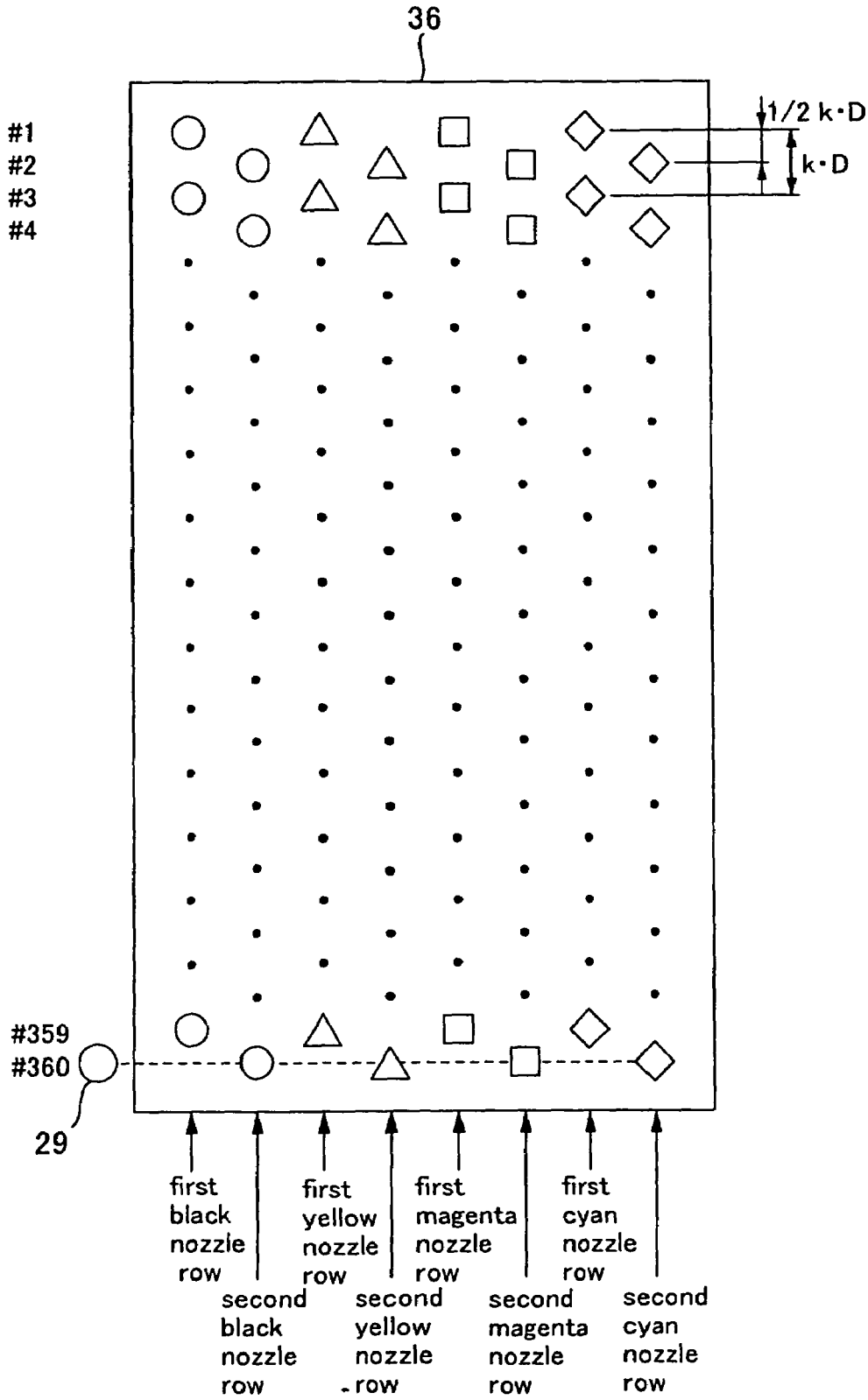
FIG. 8 is an explanatory diagram showing the nozzle arrangement on the bottom surface of a print head 36.

FIG. 8 is an explanatory diagram showing the nozzle arrangement on the bottom surface of the print head 36. The print head 36 has a black nozzle row, a yellow nozzle row, a magenta nozzle row, and a cyan nozzle row, arranged in straight lines in the sub-scanning direction. As shown in the diagram, each of these nozzle rows is constituted by two rows, and in this specification, these nozzle rows are referred to as the first black nozzle row, the second black nozzle row, the first yellow nozzle row, the second yellow nozzle row, the first magenta nozzle row, the second magenta nozzle row, the first cyan nozzle row, and the second cyan nozzle row.

The black nozzle rows (shown by circles) have 360 nozzles, nozzles #1 to #360. Of these nozzles, the odd-numbered nozzles #1, #3, . . . , #359 belong to the first black nozzle row and the even-numbered nozzles #2, #4, . . . , #360 belong to the second black nozzle row. The nozzles #1, #3, . . . , #359 of the first black nozzle row are arranged at a constant nozzle pitch k·D in the sub-scanning direction. Here, D is the dot pitch in the sub-scanning direction, and k is an integer. The dot pitch D in the sub-scanning direction is equal to the pitch of the main scan lines (raster lines). Hereafter, the integer k indicating the nozzle pitch k·D is referred to simply as the "nozzle pitch k." In the example of FIG. 8, the nozzle pitch k is four dots. The nozzle pitch k, however, may be set to any integer.

The nozzles #2, #4, . . . , #360 of the second black nozzle row are also arranged at the constant nozzle pitch k·D (nozzle pitch k=4) in the sub-scanning direction, and as shown in the diagram, the positions of the nozzles in the sub-scanning direction are misaligned with the positions of the nozzles of the first black nozzle row in the sub-scanning direction. In the example of FIG. 8, the amount of this misalignment is ½·k·D (k=4).

The above-described matters also apply for the yellow nozzle rows (shown by white triangles), the magenta nozzle rows (shown by white squares), and the cyan nozzle rows (shown by white diamonds). In other words, each of the these nozzle rows has 360 nozzles #1 to #360, and of the these nozzles, the odd-numbered nozzles #1, #3, . . . , #359 belong to the first nozzle row and the even-numbered nozzles #2, #4, . . . , #360 belong to the second nozzle row. Also, each of these nozzle rows is arranged at a constant nozzle pitch k·D in the sub-scanning direction, and the positions of the nozzles of the second rows in the sub-scanning direction are misaligned with the positions of the nozzles of the first rows in the sub-scanning direction by ½·k·D (k=4).

In other words, the nozzle groups arranged in the print head 36 are staggered, and during printing, ink droplets are ejected from each of the nozzles while the print head 36 is moved in the main-scanning direction at a constant velocity together with the carriage 28. However, depending on the print mode, all of the nozzles are not necessarily always being used, and there are instances in which only some of the nozzles are used.

It should be noted that the above-described reflective optical sensor 29 is provided in the carriage 28 together with the print head 36, and in this embodiment, as shown in the diagram, the position of the reflective optical sensor 29 in the sub-scanning direction matches the position of the above-described nozzles #360 in the sub-scanning direction.

First Embodiment

Figures 9A, 9B, 9C:
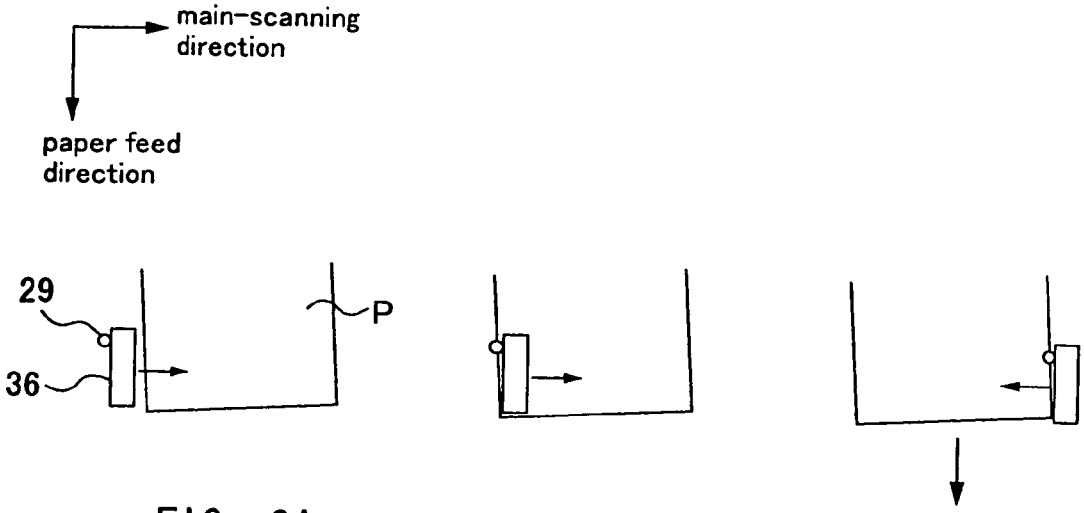
FIG. 9A through FIG. 9F are diagrams schematically showing positional relationships between the print head 36, the reflective optical sensor 29, and print paper P according to an embodiment of the present invention.
Figures 9D, 9E, 9F:
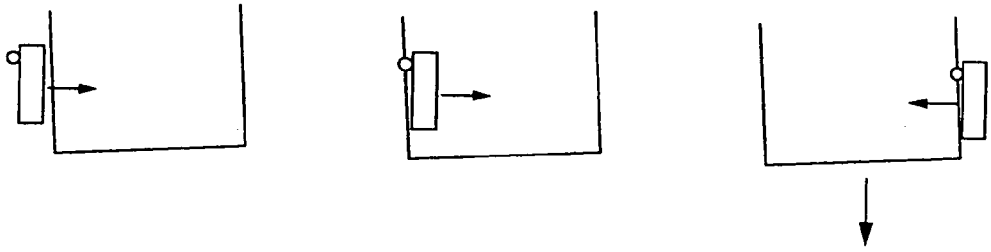
Figure 10:
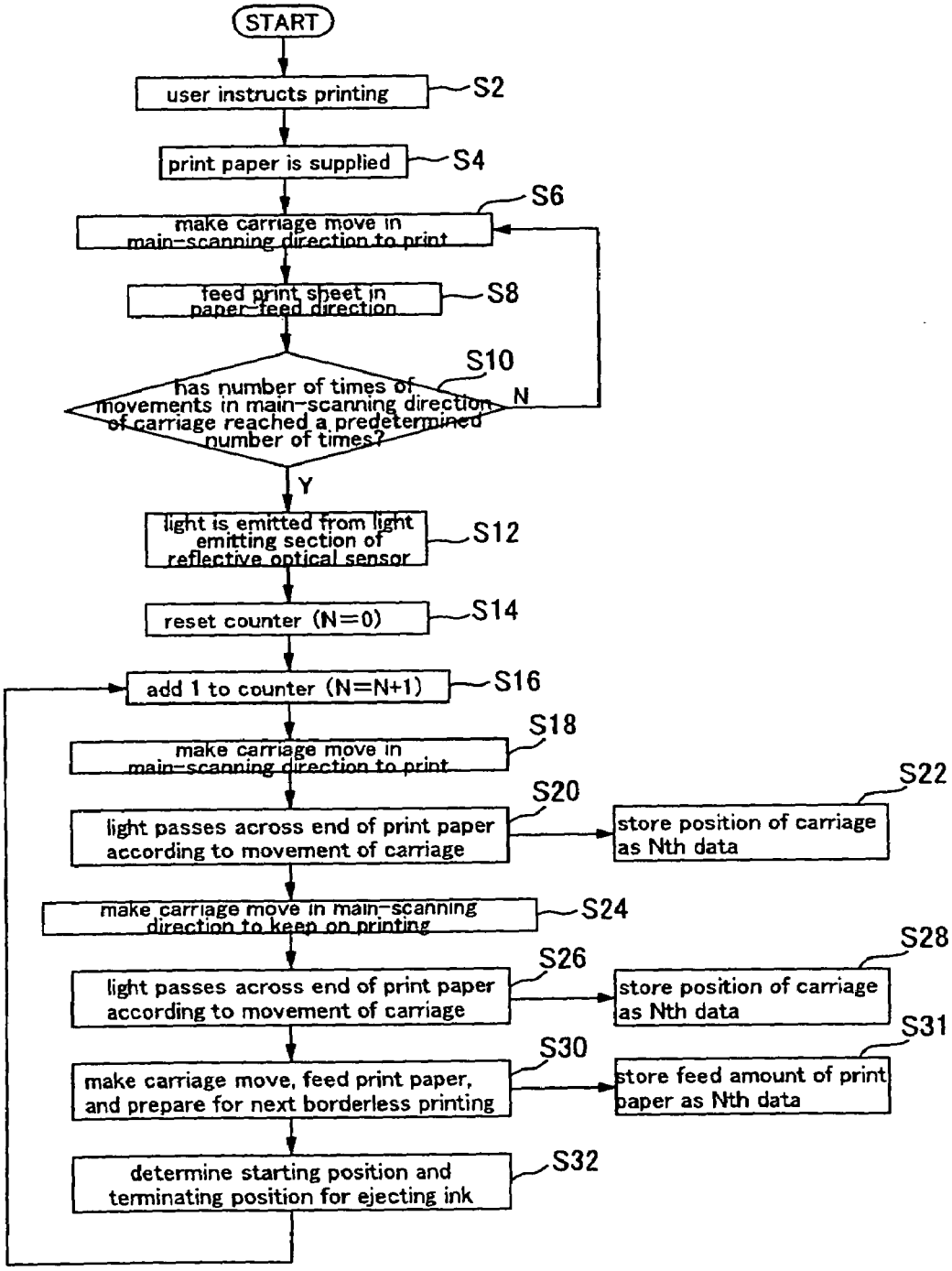
FIG. 10 is a flowchart for describing the first embodiment.

Next, a first embodiment of the present invention is described using FIG. 9A through FIG. 9F and FIG. 10. FIG. 9A through FIG. 9F are diagrams schematically showing positional relationships between the print head 36, the reflective optical sensor 29, and the print paper P. FIG. 10 is a flowchart for describing the first embodiment.

First, the user makes a command to perform printing through the application program 95 or the like (step S2). The application program 95 receives this instruction and issues a print command, at which time the printer driver 96 of the computer 90 receives image data from the application program 95 and converts them to print data PD including raster data indicating the state in which dots are formed during main scanning and data indicating the sub-scanning feed amount. Moreover, the printer driver 96 supplies the print data PD to the color inkjet printer 20 together with various commands COM. The color inkjet printer 20 receives these at its buffer memory 50, after which it sends them to the image buffer 52 or the system controller 54.

The user can also designate the size of the print paper P or issue a command to perform borderless printing to the user interface display module 101. This instruction by the user is received by the user-interface display module 101 and sent to the UI printer interface module 102. The UI printer interface module 102 interprets the instruction that has been given, and sends a command COM to the color inkjet printer 20. The color inkjet printer 20 receives the command COM at the buffer memory 50 and then transmits it to the system controller 54.

The color inkjet printer 20 then drives, for example, the paper feed motor 31 by the sub-scanning feed drive circuit 62 based on the command that is sent to the system controller 54 so as to feed the print paper P (step S4).

Then, the system controller 54 moves the carriage 28 in the main-scanning direction as it feeds the print paper P in the paper feed direction, and ejects ink from the print head 36 provided in the carriage 28, thereby carrying out borderless printing (step S6, step S8). It should be noted that the print paper P is fed in the paper feed direction by driving the paper feed motor 31 with the sub-scanning feed drive circuit 62, the carriage 28 is moved in the main-scanning direction by driving the carriage motor 30 with the main scan drive circuit 61, and ink is ejected from the print head 36 by driving the print head 36 with the head drive circuit 63.

The color inkjet printer 20 carries out the operations of step S6 and step S8 in sequence, and if the number of times the carriage 28 is moved in the main-scanning direction reaches a predetermined number of times (step S10), for example, then, after the carriage 28 is next moved in the main-scanning direction, the following operation is performed.

The system controller 54 controls the reflective optical sensor 29, which is provided in the carriage 28, by the reflective optical sensor control circuit 65, so that light is emitted toward the platen 26 from the light emitting section 38 of the reflective optical sensor 29 (step S12).

A counter (not shown) for counting the following series of operations that is repeated is prepared, and at this timing, the system controller 54 resets the counter (step S14). The system controller 54 resets the counter by, for example, setting the counter value N to zero. Next, the system controller 54 adds "1" to the counter value N (step S16), and then, as shown in FIG. 9A and FIG. 9B, the system controller 54 makes the main-scanning drive circuit 61 drives the CR motor 30 to move the carriage 28 (step S18) in order to carry out borderless printing by ejecting ink from the print head 36 provided on the carriage 28. Then, as shown in FIG. 9B, the light emitted from the light emitting section 38 passes across an end of the print paper P (step S20). At this time, since the target of incidence of the light emitted from the light emitting section 38 changes from the platen 26 to the print paper P, the intensity of the electrical signal, which is the output value of the light receiving section 40 of the reflective optical sensor 29 that receives the reflected light, also changes. The intensity of the electrical signal is measured by the electrical signal measuring section 66, and accordingly, the system controller 54 detects that the light has passed across the end of the print paper P.

Then, the amount of movement of the CR motor 30 from the reference position is determined based on the output pulse of the linear encoder 11, and the amount of movement, i.e., the position of the carriage 28 is stored as the Nth data (step S22).

As shown in FIG. 9B and FIG. 9C, even after step S16 and step S18, the system controller 54 keeps making the carriage 28 move and carries out borderless printing by ejecting ink from the print-head 36 provided on the carriage 28 (step S24).

Then, as shown in FIG. 9C, the light emitted from the light emitting section 38 passes across another end (i.e., an end whose position, in the main-scanning direction, is different from the end passed at step S20) of the print paper P (step S26). At this time, since the target of incidence of the light emitted from the light emitting section 38 changes from the print paper P to the platen 26, the intensity of the electrical signal, which is the output value of the light receiving section 40 of the reflective optical sensor 29 that receives the reflected light, also changes. The intensity of the electrical signal is measured by the electrical signal measuring section 66, and accordingly, the system controller 54 detects that the light has passed across the end of the print paper P.

Then, the amount of movement of the CR motor 30 from the reference position is determined based on the output pulse of the linear encoder 11, and the amount of movement, i.e., the position of the carriage 28 is stored as the Nth data (step S28).

Then, as shown in FIG. 9C and FIG. 9D, the system controller 54 drives the CR motor 30 to make the carriage 28 move as well as drives the paper feed motor 31 to feed the print paper P by a predetermined amount, and prepares for the next borderless printing (step S30).

Then, the system controller 54 determines the amount of movement of the PF motor 31 from a reference position based on the output pulse of the rotary encoder 13, and stores the amount of movement, i.e., the feed amount of print paper P (step S31).

Next, as shown in FIG. 9D and FIG. 9E, the system controller 54 makes the main-scanning drive circuit 61 drive the CR motor 30 to move the carriage 28 (step S18) in order to perform borderless printing by ejecting ink from the print head 36 provided on the carriage 28. However, before this operation, the system controller 54 determines the ink ejection starting position and the ink ejection terminating position of the print head 36 (step S32). The way of determining the ink ejection starting position and the ink ejection terminating position will be described later.

Next, the procedure returns to step S16. The system controller 54 adds "1" to the counter value N (step S16), and then, as shown in FIG. 9D, FIG. 9E, and FIG. 9F, the procedure of from step S18 through step S48 described above are executed. During the procedure, the system controller 54 controls the head drive circuit 63 so that ink ejection is started from the ink ejection starting position that has been determined and the ink ejection is terminated at the ink ejection terminating position that has been determined.

As shown by the loop structure in the flowchart of FIG. 10, after this point, the procedures of from step S16 through step S48 are repeated.

Figure 11:
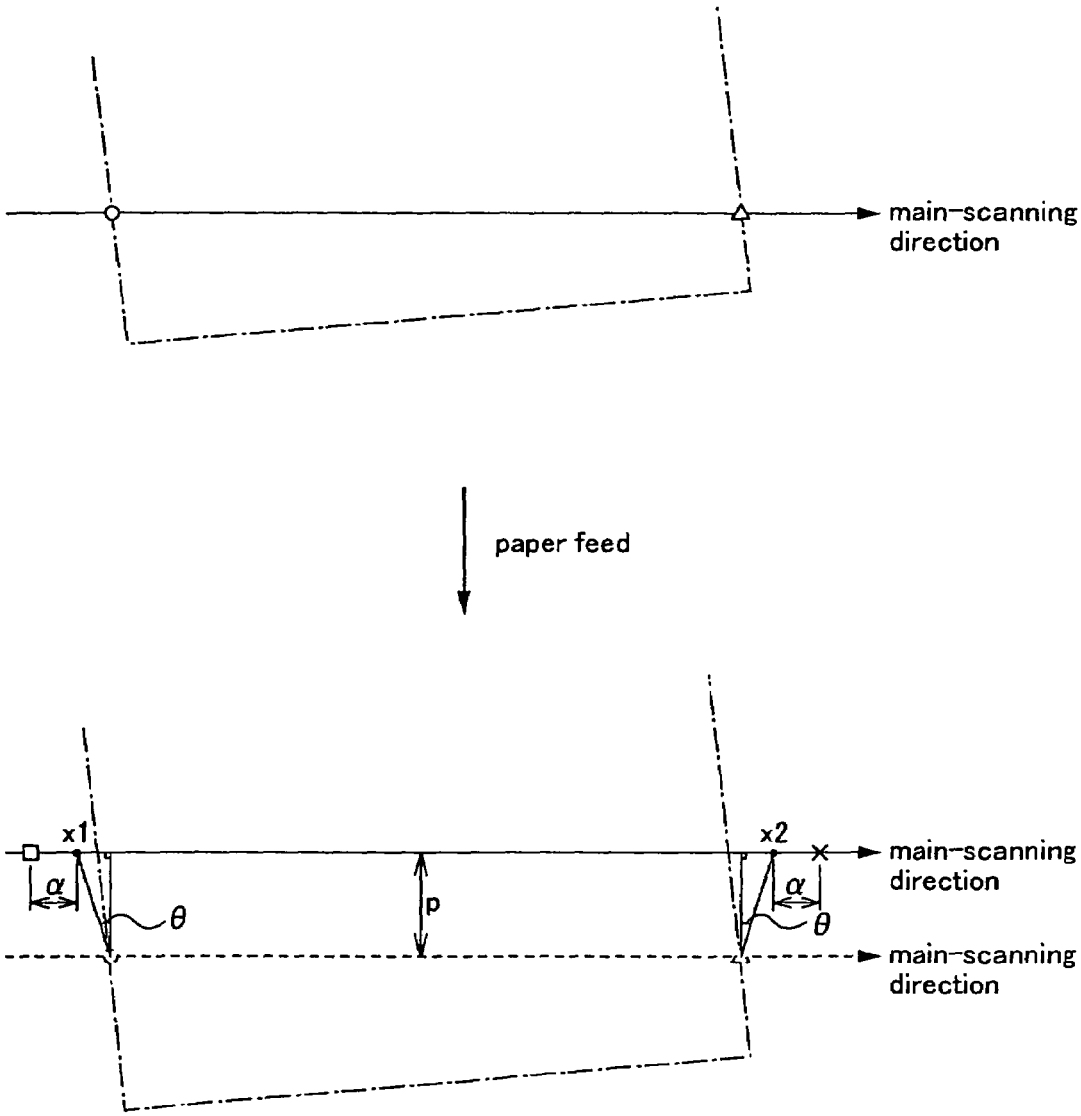
FIG. 11 is an explanatory diagram for illustrating how to determine the ink ejection starting position and the ink ejection terminating position according to an embodiment of the present invention.

Next, with reference mainly to FIG. 11 and also to FIG. 9A through FIG. 9F and FIG. 10, an example of how to determine the ink ejection starting position and the ink ejection terminating position will be described. FIG. 11 is an explanatory diagram for illustrating how to determine the ink ejection starting position and the ink ejection terminating position.

The circle on the left-hand side in the upper diagram of FIG. 11 indicates the position of the reflective optical sensor 29 when the end of the print paper P is detected in the state shown in FIG. 9B (at step S20). The triangle on the right-hand side in the upper diagram of FIG. 11 indicates the position of the reflective optical sensor 29 when the end of the print paper P is detected in the state shown in FIG. 9C (at step S26). It should be noted that in the figure, the print paper P is indicated by alternate long-and-short dashed lines, and the direction in which the carriage 28 (the reflective optical sensor 29) moves is indicated by the arrow.

The solid-line arrow shown in the lower diagram of FIG. 11 indicates the direction in which the carriage 28 (the reflective optical sensor 29) moves after the print paper P has been fed (at step S30), and the dotted-line arrow indicates the direction in which the carriage 28 (the reflective optical sensor 29) moves before the print paper P is fed (at step S30). The dotted-line arrow in the lower diagram of FIG. 11 corresponds to the arrow in the upper diagram of FIG. 11, except that it is depicted in a different diagram, and therefore, the dotted-line circle and the dotted-line triangle in the lower diagram of FIG. 11 correspond to the circle and the triangle in the upper diagram of FIG. 11, respectively.

In the lower diagram of FIG. 11, a perpendicular line is dropped from the dotted-line circle to the solid-line arrow. A point (the square in the lower diagram of FIG. 11) that is distance $\alpha$ away, on the upstream side in the main-scanning direction, from a point (point x1 in the lower diagram of FIG. 11) where a line that forms an angle of $\theta$ with the above-mentioned perpendicular line intersects the above-mentioned solid-line arrow is adopted as the above-mentioned ink ejection starting position. Similarly, a perpendicular line is dropped from the dotted-line triangle to the solid-line arrow, and a point (the X in the lower diagram of FIG. 11) that is distance a away, on the downstream side in the main-scanning direction, from a point (point x2 in the lower diagram of FIG. 11) where a line that forms an angle of $\theta$ with the above-mentioned perpendicular line intersects the above-mentioned solid-line arrow is adopted as the ink ejection terminating position. That is, the system controller 54 starts ink ejection at a position that is distance ($\alpha+p\cdot\tan\theta$) upstream of (i.e., advanced from) the position of the carriage 28 when the end of the print paper P was detected at step S20, and terminates the ink ejection at a position that is distance ($\alpha+p\cdot\tan\theta$) downstream of (i.e., delayed from) the position of the carriage 28 when the end of the print paper P was detected at step S26.

The above-mentioned angle "$\theta$" is a predicted maximum skew angle of the print paper P. This maximum skew angle is set by predicting an angle up to which the print paper may skew (slant), based on information such as the structure and/or mechanism of the printing apparatus. Further, the above-mentioned distance "$\alpha$" is the amount of margin set based on information such as detection error upon detecting the end of the print paper P. In this example, the amount of margin $\alpha$ is the same for determining both the ink ejection starting position and the ink ejection terminating position. However, different values may be adopted for determining the starting and terminating positions. Further, the above-mentioned length "p" is the paper-feed amount for the print paper P that is fed at step S30 and is determined from the data stored at step S31.

A program for carrying out the above-mentioned processes is stored in the EEPROM 58, and the program is executed by the system controller 54.

As described in the "BACKGROUND OF THE INVENTION", in case of performing borderless printing, since printing is carried out with respect to the entire surface of the print paper, it is important that no borders are created on the end sections of the print paper being printed. In order to do so, it is advantageous to prepare print data that is somewhat larger than the print paper, i.e., that has somewhat of a margin compared to the size of the print paper, and to print on the print paper using such print data, giving consideration to situations in which the print paper is supplied in a slanted (skewed) manner.

Further, in order to alleviate the problem caused when adopting the above-mentioned method, that is, the problem that ink is wasted because printing is performed in regions outside the print paper, it is also advantageous to detect the position of the end of the print paper using a detector, and change the starting position and/or the terminating position for ejecting ink in accordance with the detected end position.

However, in adopting the above-mentioned measure, the problem that ink is wasted will occur if the starting position and/or the terminating position for ejecting ink from the print head is determined without giving any consideration to the feed amount by which the print paper is fed using a paper feed motor after the position of the end of the print paper has been detected.

More specifically, the appropriate starting position or the terminating position for ejecting ink when giving consideration to such aspects as not to create any unnecessary borders in the print paper while causing no waste of ink will change according to the magnitude of the feed amount by which the print paper is fed by the paper feed motor after the position of the end of the print paper has been detected. Despite such a fact, if the starting position or the terminating position for ejecting ink is determined irrelevant to the feed amount, the timing at which ink ejection is started will be excessively advanced and the timing at which the ink ejection is terminated will be excessively delayed as a result of placing too much importance on trying to keep unnecessary borders from being created on the print paper without taking the magnitude of the feed amount into consideration. This gives rise to the problem that ink is wasted.

In view of such circumstances, by changing, according to the feed amount of the print paper fed by the paper feed motor after said position of the end of the print paper has been detected with the reflective optical sensor, at least either a starting position or a terminating position for ejecting ink from the print head being moved as described above, it becomes possible to solve the above-mentioned problems.

For example, as explained by the above-mentioned embodiment, by starting ink ejection at a position that is distance $\alpha+\cdot p \tan\theta$ (which is a function of the feed amount "p" of the print paper) upstream of (i.e., advanced from) the position of the carriage 28 when the end of the print paper P was detected at step S20, and terminating the ink ejection at a position that is distance $\alpha+p\cdot\tan\theta$ (which is a function of the feed amount "p" of the print paper) downstream of (i.e., delayed from) the position of the carriage 28 when the end of the print paper P was detected at step S26, in other words, by changing the starting position and the terminating position for ejecting ink according to the feed amount p of the print paper, it becomes possible to reduce the amount of ink consumed.

Other Embodiments

In the foregoing, an ink ejection method, for example, according to the invention was described based on an embodiment thereof. However, the foregoing embodiment is for the purpose of elucidating the present invention and are not to be interpreted as limiting the present invention. The invention can of course be altered and improved without departing from the gist thereof and includes functional equivalents.

Print paper was described as an example of the medium, but it also possible to use film, cloth, and thin metal sheets, and the like as the medium.

In the foregoing embodiment, a printing apparatus was described as an example of the liquid ejection apparatus. However, this is not a limitation. For example, technology like that of the embodiments can also be adopted for color filter manufacturing devices, dyeing devices, fine processing devices, semiconductor manufacturing devices, surface processing devices, three-dimensional shape forming machines, liquid vaporizing devices, organic EL manufacturing devices (particularly macromolecular EL manufacturing devices), display manufacturing devices, film formation devices, and DNA chip manufacturing devices. The above-described effects can be maintained even when the present technology is adopted in these fields because of the feature that liquid can be ejected toward a medium.

In the above embodiment, a color inkjet printer was described as an example of the printing apparatus; however, this is not a limitation. For example, the present invention can also be applied to monochrome inkjet printers.

Also, in the above embodiments, ink was used as an example of the liquid; however, this is not a limitation. For example, it is also possible to eject from the nozzles a liquid (including water) including metallic material, organic material (particularly macromolecular material), magnetic material, conductive material, wiring material, film-formation material, processed liquid, and genetic solution.

Further, in the embodiment described above, the print head starts ink ejection at the starting position and terminates ink ejection at the terminating position; and the greater the feed amount of the print paper, which has been fed by the paper feed motor after the position of the end of the print paper has been detected, the further the start of ink ejection is advanced or the further the termination of ink ejection is delayed. However, the configuration is not limited to the above. For example, the starting position or the terminating position may be set to a constant position after the magnitude of the feed amount reaches a predetermined value.

However, the above-described embodiment is preferable because, in this way, it becomes possible to reduce the amount of ink consumed more effectively.

Further, in the embodiment described above, the start of ink ejection is advanced or the termination of ink ejection is delayed in proportion to the magnitude of the feed amount. However, the configuration is not limited to the above.

However, the above-described embodiment is preferable because, in this way, it becomes possible to determine the appropriate ink ejection starting position or ink ejection terminating position, giving consideration to such aspects such as not to create any unnecessary margins (borders) in the print paper while causing no waste of ink.

Further, in the embodiment described above, at least either the starting position or the terminating position for ejecting the ink from the print head being moved is changed according to the feed amount of the print paper fed after the position of the end of the print paper has been detected, and a predicted maximum skew angle of the print paper. However, the configuration is not limited to the above. For example, an actual skew angle of the print paper that has been fed may be determined, and the actual skew angle may be used instead of the predicted maximum skew angle of the print paper.

However, the above-described embodiment is preferable because, since it is possible to omit the procedure of determining an actual skew angle of the print paper that has been fed, it becomes possible to easily achieve the above-mentioned effect, that is, the effect of being able to reduce the amount of ink used.

Further, in the embodiment described above, printing is performed targeting on an entire surface of the print paper, that is, so-called borderless printing is performed. However, the configuration is not limited to the above. For example, the above-mentioned measures achieve advantageous effects when printing in a wide range of the print paper, but not the entire surface of the print paper P.

However, the advantages obtained by the above-mentioned measures become more significant in the case of borderless printing, because printing is performed also in the end sections of the print paper.

Further, in the embodiment described above, the position of the end of the print paper is detected by a reflective optical sensor; the reflective optical sensor includes a light emitting section for emitting light, and a light receiving section for receiving the light that moves in a main-scanning direction in accordance with a movement of the reflective optical sensor in the main-scanning direction; and the position of the end of the print paper is detected according to a change in an output value of the light receiving section that is caused by passing of the light, which has been emitted from the light emitting section moving in the main-scanning direction, across the end of the print paper. However, the configuration is not limited to the above.

However, the above-described embodiment is preferable because, in this way, it becomes possible to detect the end position more easily.

Further, in the embodiment described above, each position of two ends of the print paper that differ in position in the main-scanning direction is detected according to a change in output values of the light receiving section that is caused by passing of the light, which has been emitted from the light emitting section moving in the main-scanning direction, across each of the two ends of the print paper; the starting position is changed in accordance with the position of one of the two ends having been detected; and the terminating position is changed in accordance with the position of the other one of the two ends having been detected. However, the configuration is not limited to the above. For example, the position of one end of the print paper may be detected during the above-mentioned detecting operation according to a change in the output value of the light receiving section that is caused by passing of the light, which has been emitted from the light emitting section moving in the main-scanning direction, across that end of the print paper, and the starting position or the terminating position may be changed in accordance with the position of that detected end.

However, the above-described embodiment is preferable because in this way, the above-mentioned effect, that is, the effect of being able to reduce the amount of liquid consumed will be brought about more significantly.

Further, in the embodiment described above, the reflective optical sensor is provided in/on a movable carriage that comprises the print head. However, the configuration is not limited to the above. For example, the reflective optical sensor and the carriage may be configured to be able to move independently of each other.

However, the above-described embodiment is preferable because, in this way, the carriage and the mechanism for moving the reflective optical sensor can be used in common.

Further, in the embodiment described above, while making the carriage move in a main-scanning direction, the position of the end of the print paper is detected according to a change in an output value of the light receiving section that is caused by passing of the light, which has been emitted from the light emitting section moving in the main-scanning direction, across the end of the print paper, and the ink is ejected from the print head onto the print paper. However, the configuration is not limited to the above. For example, the detecting operation and the ejecting operation may be performed independently.

However, the above-described embodiment is preferable because, in this way, it becomes possible to realize efficient operation.

Configuration of Computer System Etc.

Next, an embodiment of a computer system, which is an example of an embodiment of the present invention, will be described with reference to the drawings.

Figure 12:
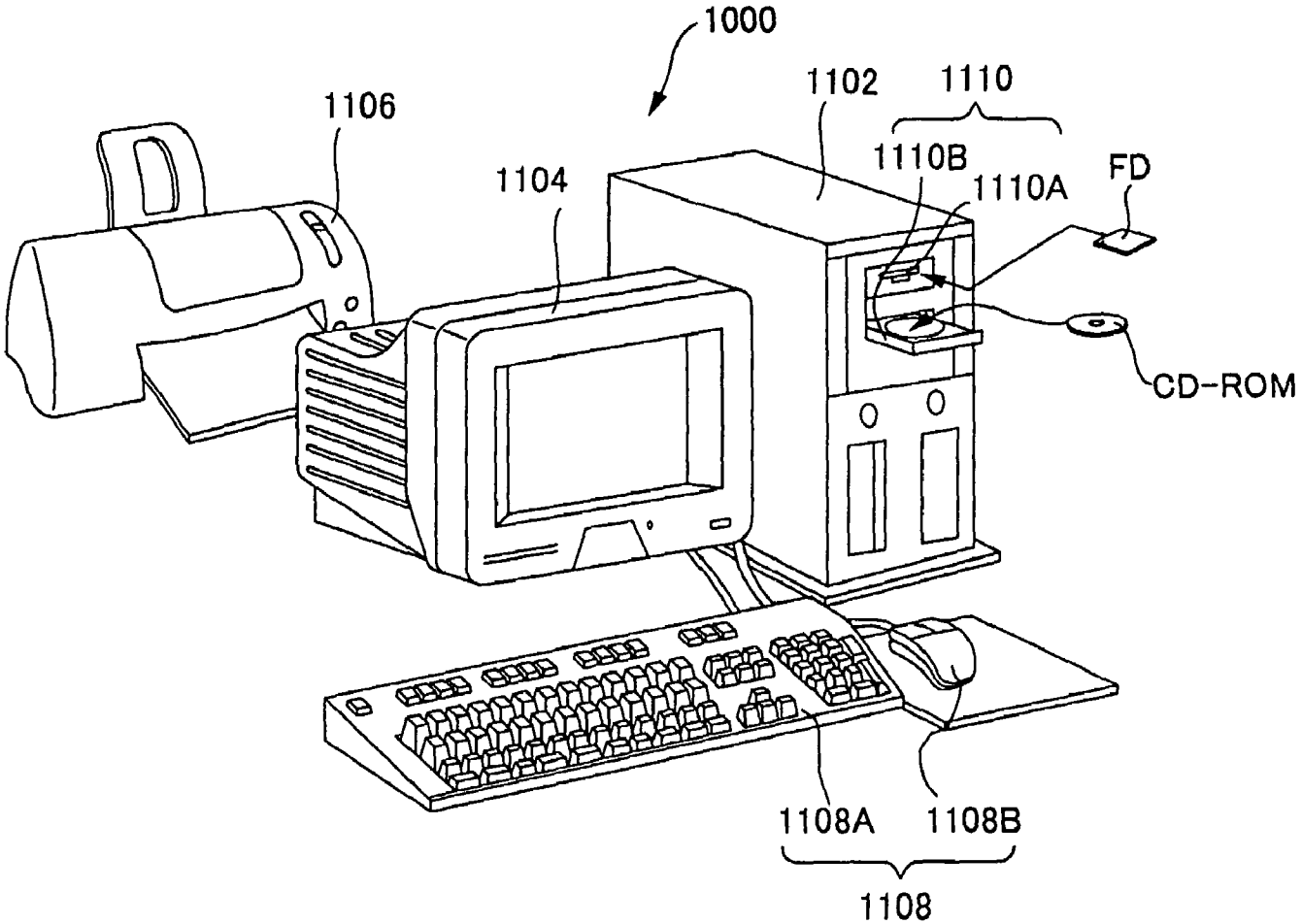
FIG. 12 is an explanatory diagram showing the external configuration of a computer system.

FIG. 12 is an explanatory diagram showing the external configuration of a computer system. The computer system 1000 includes: a computer unit 1102; a display device 1104; a printer 1106; an input device 1108; and a reading device 1110. In the present embodiment; the computer unit 1102 is housed in a mini-tower casing; however the structure is not limited to this example. Although a CRT (cathode ray tube), a plasma display, or a liquid crystal display device is generally used as the display device 1104, any other kinds of devices can be used. The printer described above is used as the printer 1106. In the present embodiment, a keyboard 1108A and a mouse 1108B are used as the input device 1108; however, any other kinds of devices can be used. In the present embodiment, a flexible disk drive device 1110A and a CD-ROM drive device 1110B are used as the reading device 1110; however, it is also possible to use an MO (magneto-optical) disk drive device, a DVD (digital versatile disk) drive, or any other kinds of devices.

Figure 13:
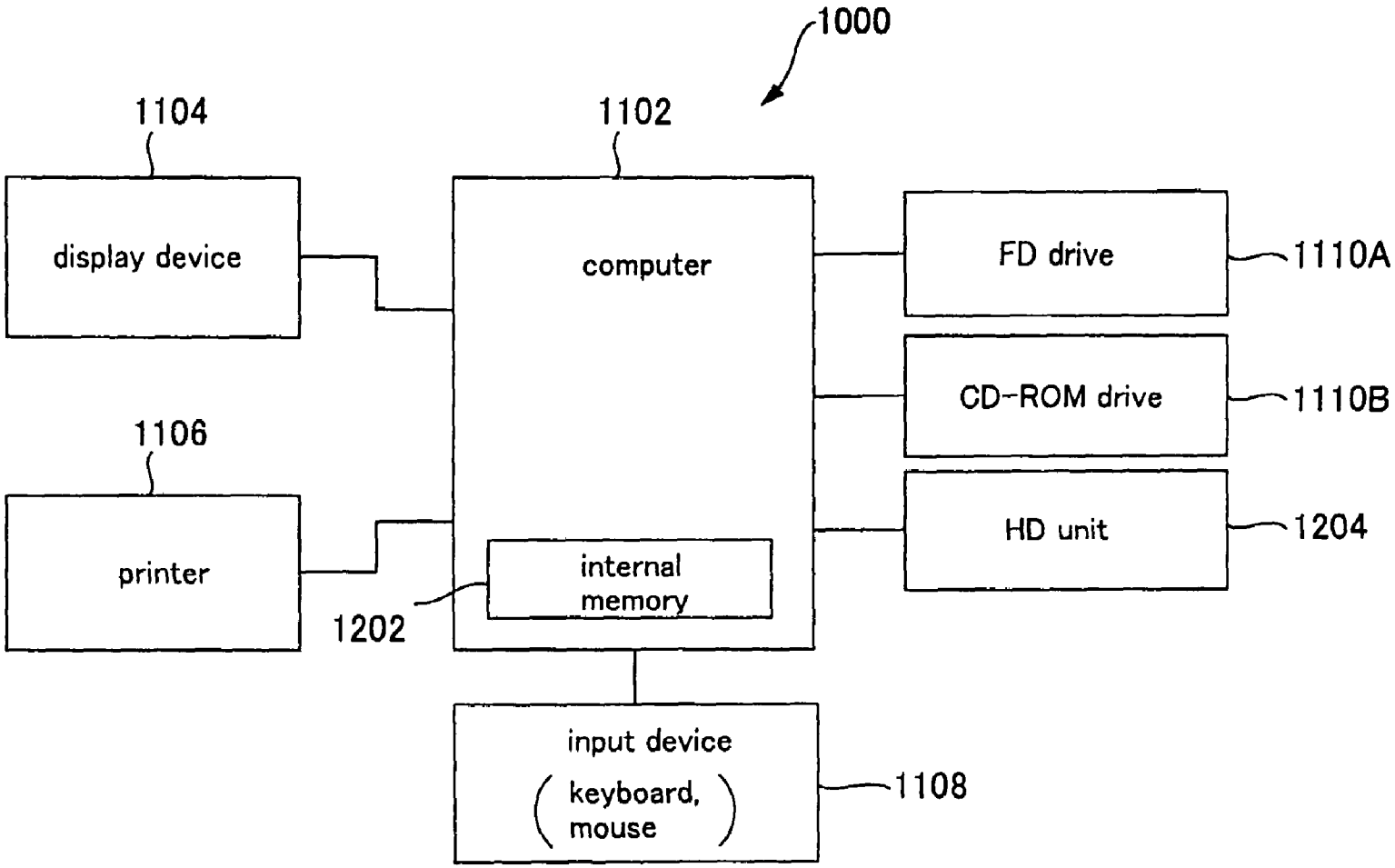
FIG. 13 is a block diagram showing the configuration of the computer system shown in FIG. 12.

FIG. 13 is a block diagram showing the configuration of the computer system shown in FIG. 12. FIG. 13 shows that an internal memory 1202, such as a RAM, provided inside the casing in which the computer unit 1102 is housed, and an external memory, such as a hard-disk drive unit 1204, are also provided.

In the above, description was made of an example in which the printer 1106 is connected to the computer unit 1102, the display device 1104, the input device 1108, and the reading device 1110 to configure the computer system. However, the configuration is not limited to the above. For example, the computer system may be configured comprising only the computer unit 1102 and the printer 1106, and it does not have to comprise any one of the display device 1104, the input device 1108, and the reading device 1110.

Further, for example, it is also possible for the printer 1106 to have some of the functions or mechanisms of each of the computer unit 1102, the display device 1104, the input devices 1108, and the reading device 1110. For example, it is possible to structure the printer 1106 so that it comprises an image processor for processing images, a display section for performing various kinds of displaying, and a recording media mounting section for detachably mounting a recording medium on which image data captured with a digital camera or the like is stored.

A computer system configured as above will be superior to existing computer systems as a whole.

According to the present invention, it becomes possible to provide a liquid ejection method and a liquid ejecting apparatus capable of reducing the amount of liquid consumed.

Although the preferred embodiment of the present invention has been described in detail, it should be understood that various changes, substitutions and alterations can be made therein without departing from spirit and scope of the inventions as defined by the appended claims.

What is claimed is:

1. A liquid ejection method of ejecting liquid from a movable ejection head onto a medium, said method comprising:

detecting a position of an edge of the medium, wherein the edge is substantially perpendicular to a main-scanning direction; and setting, based on a result of detecting the position of the edge of the medium, an area to which the liquid is to be ejected, wherein the main-scanning direction is a direction in which the movable ejection head travels;

wherein the area to which the liquid is to be ejected is set by changing, according to a feed amount of the medium fed after the position of the edge of the medium has been detected, at least either a starting position or a terminating position, in the main-scanning direction, for ejecting the liquid from the ejection head being moved; and wherein the ejection head starts liquid ejection at the starting position and terminates liquid ejection at the terminating position; and the greater the feed amount is, the further the start of liquid ejection is advanced or the further the termination of liquid ejection is delayed in the main-scanning direction.

2. A liquid ejection method according to claim 1, wherein the start of liquid ejection is advanced or the termination of liquid ejection is delayed in proportion to a magnitude of the feed amount.

3. A liquid ejection method according to claim 1, wherein at least either the starting position or the terminating position, in the main-scanning direction for ejecting the liquid from the ejection head being moved is changed according to the feed amount of the medium fed after the position of the edge of the medium has been detected, and a predicted maximum skew angle of the medium.

4. A liquid ejection method according to claim 1, where the liquid is ejected targeting on an entire surface of the medium.

5. A liquid ejection method according to claim 1, wherein:

the position of the edge of the medium is detected by a sensor;

the sensor includes a light emitting section for emitting light, and a light receiving sensor for receiving the light that moves in the main scanning direction in accordance with a movement of the sensor in the main-scanning direction; and the position of the edge of the medium is detected according to a change in an output value of the light receiving sensor that is caused by passing of the light, which has been emitted from the light emitting section moving in the main-scanning direction, across the edge of the medium.

6. A liquid ejection method according to claim 5, wherein:

each position of two edges of the medium that differ in position in the main-scanning direction is detected according to a change in output values of the light receiving sensor that is cause by passing of the light, which has been emitted from the light emitting section moving in the main-scanning direction, across each of the two edges of the medium;

the starting position is changed in accordance with the position of one of the two edges having been detected; and the terminating position is changed in accordance with the position of the other one of the two edges having been detected.

7. A liquid ejection method according to claim 6, wherein:

while making the moving member move in the main-scanning direction, the position of the edge of the medium is detected according to a change in an output value of the light receiving sensor that is caused by passing of the light, which has been emitted from the light emitting section moving in the main-scanning direction, across the edge of the medium, and the liquid is ejected from the ejection head onto the medium.

8. A liquid ejection method according to claim 1, wherein:

the position of the edge of the medium is detected by a sensor;

the sensor is provided in/on a movable moving member that comprises the ejection head; and the sensor includes a light emitting section for emitting light, and a light receiving sensor for receiving the light that moves in a main-scanning direction in accordance with a movement of the sensor in the main-scanning direction.

9. A liquid ejection method according to claim 1, wherein:

the liquid is ink; and printing is carried out on a print medium, which is the medium, by ejecting the ink from the ejection head.

10. A liquid ejecting apparatus comprising:

an ejection head, movable in a main-scanning direction, for ejecting liquid;

a sensor for detecting a position of an edge of the medium, wherein the edge is substantially perpendicular to the main-scanning direction; and a controller for setting, based on a result of detecting the position of the edge of the medium by the sensor, an area to which the liquid is to be ejected, wherein the main-scanning direction is a direction in which the movable ejection head travels;

wherein the area to which the liquid is to be ejected is set by changing, according to a feed amount of the medium fed after the position of the edge of the medium has been detected, at least either a starting position or a terminating position, in the main-scanning direction, for ejecting the liquid from the ejection head being moved; and wherein the ejection head starts liquid ejection at the starting position and terminates liquid ejection at the terminating position; and the greater the feed amount is, the further the start of liquid ejection is advanced or the further the termination of liquid ejection is delayed in the main-scanning direction.

* * * * *